United States Patent [19]

Howard et al.

[11] Patent Number: 4,796,057

[45] Date of Patent: Jan. 3, 1989

[54] TONER CLEANING APPARATUS

[75] Inventors: Alan C. R. Howard, Westoning; Philip R. Thompson, Harpenden; Geoffrey Watts, Welwyn Garden City, all of England

[73] Assignee: Xerox Corporation, Stamford, Conn.

[21] Appl. No.: 76,809

[22] Filed: Jul. 23, 1987

[30] Foreign Application Priority Data

Jul. 25, 1986 [GB] United Kingdom ..... 8618186

[51] Int. Cl.[4] ..... G03G 21/00

[52] U.S. Cl. ..... 355/15; 15/256.51

[58] Field of Search ..... 355/15, 3 DD, 3 R; 15/256.51

[56] References Cited

U.S. PATENT DOCUMENTS

| | | | |
|---|---|---|---|
| 3,660,863 | 5/1972 | Gerbasi | 15/256.51 |
| 3,838,472 | 10/1974 | Oriel | 15/256.51 |
| 3,966,316 | 6/1976 | Pfeifer et al. | 355/3 R |
| 3,985,436 | 10/1976 | Tanaka et al. | 355/8 |
| 4,158,498 | 6/1979 | Ohmori | 355/15 |
| 4,218,131 | 8/1980 | Ito et al. | 355/15 |
| 4,498,760 | 2/1985 | Sugiyama | 15/256.51 X |
| 4,530,594 | 7/1985 | Adachi | 15/256.51 X |
| 4,561,766 | 12/1985 | Fox et al. | 15/256.51 X |
| 4,564,283 | 1/1986 | Fox et al. | 15/256.51 X |
| 4,583,832 | 4/1986 | Kasamura et al. | 355/3 DD |

FOREIGN PATENT DOCUMENTS

| | | |
|---|---|---|
| 58-82285 | 5/1983 | Japan . |
| 59-53859 | 3/1984 | Japan . |
| 60-11868 | 1/1985 | Japan . |
| 85/04733 | 10/1985 | PCT Int'l Appl. . |

*Primary Examiner*—R. L. Moses

[57] ABSTRACT

Apparatus for separating residual toner material from the surface of a reusable photoreceptor in a reproducing machine has a cleaner blade assembly comprising a cleaner blade in a holder. The cleaner blade assembly is movable between two positions. In a first position the blade operatively engages the photoreceptor to clean off the residual toner material which is then collected in a generally enclosed chamber below. In the second position the blade assembly is spaced apart from the photoreceptor but covers the entrance to the chamber forming a sealed enclosure for the contents. Thus the toner collecting chamber is sealed by the cleaner blade alone without relying on the photoreceptor to perform a sealing function which makes the apparatus particularly suitable for use in a process cassette comprising at least a photoreceptor and, optionally, other process elements wherein the photoreceptor cannot seal the chamber because it is only loosely retained when the cassette is not in the working position in the machine.

13 Claims, 2 Drawing Sheets

TONER CLEANING APPARATUS

Figure 1:
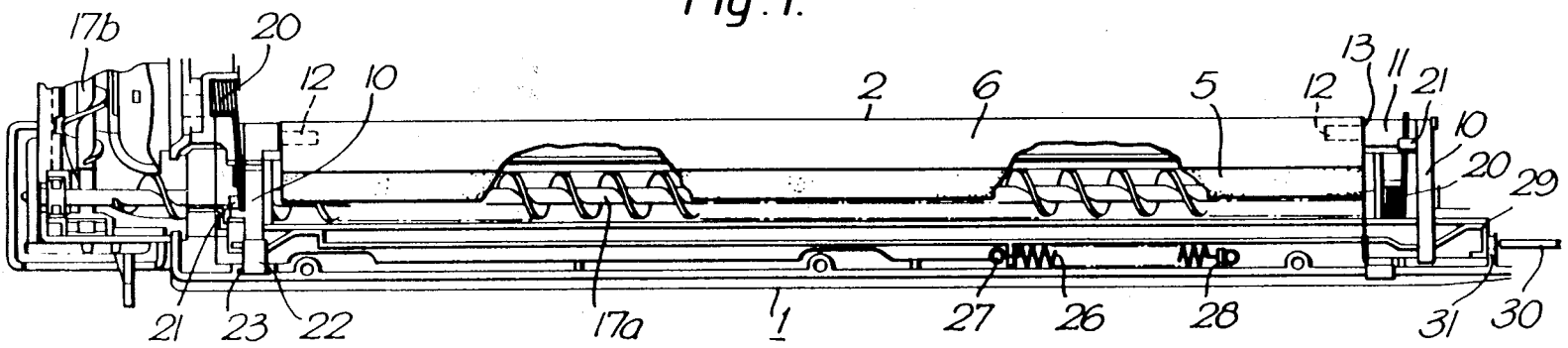

This invention relates to apparatus for separating residual toner material from the surface of a reusable image retaining member of a reproducing machine, particularly a xerographic copier. The invention also concerns such an apparatus included within a process unit adapted to be removably mounted in a main assembly of a reproducing machine wherein the process unit also includes the image retaining member.

CROSS REFERENCE

Reference is hereby made to the co-pending application entitled "Process Unit for Imaging Apparatus", Ser. No. 38,093, filed Apr. 14, 1987.

BACKGROUND OF THE INVENTION

Conventionally, in the automatic xerographic process, a latent electrostatic image of an original to be reproduced is recorded upon an image retaining member and the image then made visible, or developed, by means of a finely divided particulate toner material. In reusable xerography, the developed toner image is generally transferred from the image retaining member to a copy sheet, such as paper or the like, and the image affixed thereto to form a permanent record of the original input scene information. Although a preponderance of the toner material comprising the developed image is transferred to the copy sheet, a small amount of residual toner is nevertheless invariably left behind on the image retaining member after the transfer operation. In order to restore the image retaining member to conditions suitable for reuse, this vestige of toner must be cleaned or removed from the surface thereof before a new imaging cycle is instituted.

The cleaning of the image retaining member may be accomplished in a number of different ways. One prevalent technique is to separate the residual toner from the image retaining member by means of an elastomeric blade element as disclosed in U.S. Pat. No. 3,660,863 to Gerbasi. In the blade cleaning process, the cutting edge of the blade is arranged to move between the residual toner particles and the image bearing surface to chisel or cut the toner particles therefrom. Generally, the residual toner is collected in a chamber where it may either be stored for later disposal or recirculated for further use. In operation the chamber and entrance thereto have to be open to receive the residual toner but in such a way that the toner is confined within the chamber and so cannot escape or migrate to other parts of the xerographic machine. In practice, the chamber is usually provided closely adjacent the image retaining member and in such a manner as to form a sealed enclosure with the image retaining member itself being disposed in a sealing relationship with the chamber or chamber housing. For example, U.S. Pat. No. 3,838,472 discloses a xerographic copier with a blade cleaning arrangement in which the image retaining member is a photoconductive drum disposed such that a portion of its circumference is seated in the opening of the collecting chamber thereby covering and closing it. In that case sealing is enhanced by the inclusion below the cleaning blade of a cylindrical sealing roll arranged to ride in light biasing contact with the drum surface. It is noted that in order to reduce localized wear on the blade's cutting edge and also to prevent entrapment of foreign matter between the blade and the drum surface, the blade can be stepped longitudinally in predetermined increments back and forth across the drum surface over a path travel substantially normal to the direction of motion of the drum. However, although the blade is movable in this manner, it always remains in contact with the drum surface and does not perform any part in closing or sealing the toner collecting chamber.

In U.S. Pat. No. 4,158,498 there is disclosed a blade cleaning system in which the blade is arranged for movement between a first position in which the blade operatively engages the image retaining member to remove the residual toner therefrom and a second position at which the blade is spaced apart from the image retaining member so that the blade itself can be cleaned by a special cleaning mechanism.

Published PCT application No. WO/85 04733 discloses a cleaning apparatus for a color copier having several chambers fixed within the main assembly of the copier for collecting different color toners respectively. A respective cleaner blade is fastened to each chamber at the entrance thereto. In a first position the blades engage the photoreceptor to scrape off a respective color toner which is collected in the associated open chamber. By pivoting an entire chamber about its longitudinal axis the associated blade fixed thereto is moved to a position where it assists in closing off the chamber from receiving airborne toner particles of a color not intended to be collected. It is emphasized that in this case the cleaner blades merely assist in preventing undesired airborne toner particles from entering a particular chamber and as described they do not seal the chambers in such a manner as to prevent toner contained therein from escaping.

Recently there has been a move towards including the photoreceptor together with other process means such as a charge corotron, a development device, a transfer corotron, and especially a cleaning device in a single cassette. Examples of such cassettes are described in U.S. Pat. No. 3,985,436, Japanese Patent No. 60-11868, and Japanese Patent No. 59-53859, all of which show various combinations of process elements in a single cassette. The use of a cassette of this kind enables the easy replacement of those parts of the xerographic machine which are most likely to deteriorate with use, especially the photoreceptor, but also the development and cleaning systems as well as the corotron wires. A further advantage of containing the major xerographic process elements within a cassette is that interchangeable cassettes may be used in a given copying machine to provide different development characteristics or different colored development. U.S. Pat. No. 3,966,316 discloses a cassette incorporating both the copying drum and a brush type cleaning unit for an imaging system. Japanese Patent No. 58-82285 shows a process unit containing toner supplies to prevent toner from dispersing when the process unit is removed, and including a cleaning blade which is brought into contact with photoreceptor, only when the cassette is in position in the image forming device.

Our co-pending U.S. application Ser. No. 38,093, filed Apr. 14, 1987, which along with the other patents and publications cited herein, is incorporated by reference, concerns a process unit comprising such a xerographic process cassette in which the image retaining member is loosely retained in the process unit when the process unit is removed from the main assembly of the xerographic machine, and is adapted to be supported in an operative position by support means forming part of the main assembly when the process unit is inserted into the main assembly. This arrangement has the advantage of making the insertion and withdrawal operations simple and reliable, without the need for elaborate mechanisms to ensure that the photoreceptor arrives at exactly the correct position for an in-focus image to be formed on it by the optical system of the xerographic machine. However, when the photoreceptor is loosely retained it can no longer effectively close and seal the residual toner collecting chamber. Without the chamber being sealed the toner is able to escape into the cassette and contaminate other components in the unit particularly when the cassette is being handled outside the main assembly when it will obviously be subject to significant disturbance.

According to a first aspect of the present invention there is provided apparatus for separating residual toner material from the surface of a reusable image retaining member of a reproducing machine, comprising blade means arranged for movement between two positions wherein at the first position the blade means operatively engages the image retaining member to remove said residual toner material therefrom and that the second position the blade means is spaced apart from the image retaining member, and a generally enclosed chamber with an opening for collecting the residual toner material as it is removed by said blade means, characterized in that in said second position the blade means covers the opening and closes the chamber in such a manner as to form a sealed enclosure to prevent the toner material contained therein from escaping.

The apparatus in accordance with the invention has the advantage that the toner can be sealed in the collecting chamber by the cleaner blade alone, obviating any reliance on the photoreceptor to perform a sealing function. Hence this cleaning apparatus is ideally suited for incorporation in a process unit of the kind hereinbefore discussed wherein the photoreceptor is only loosely retained in the cassette outside the main assembly. Preferably, the blade means is moved automatically from the second sealing position to the first cleaning position when the process unit is inserted into the working position in the main assembly, and automatically moved back to the sealing position when the process unit is withdrawn.

Figure 5:
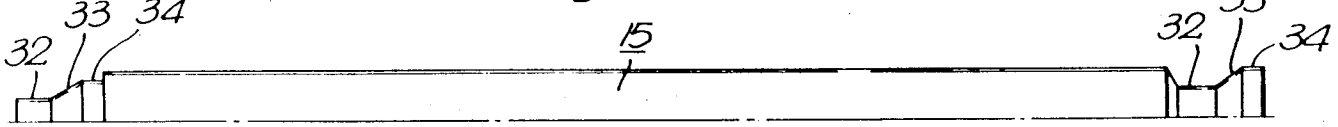
Figure 2:
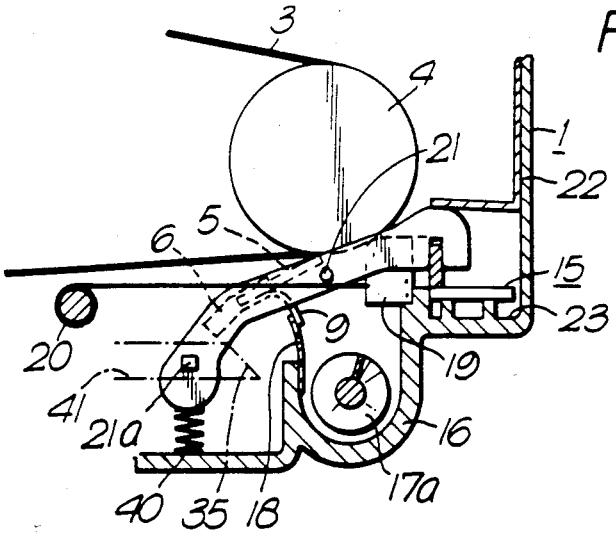
Figure 3:
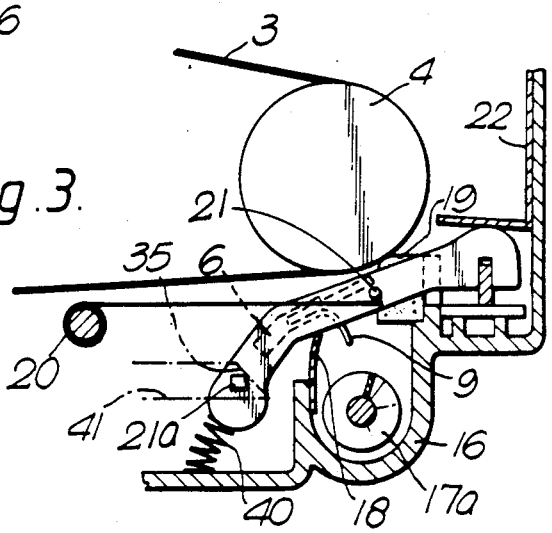
Figure 4:
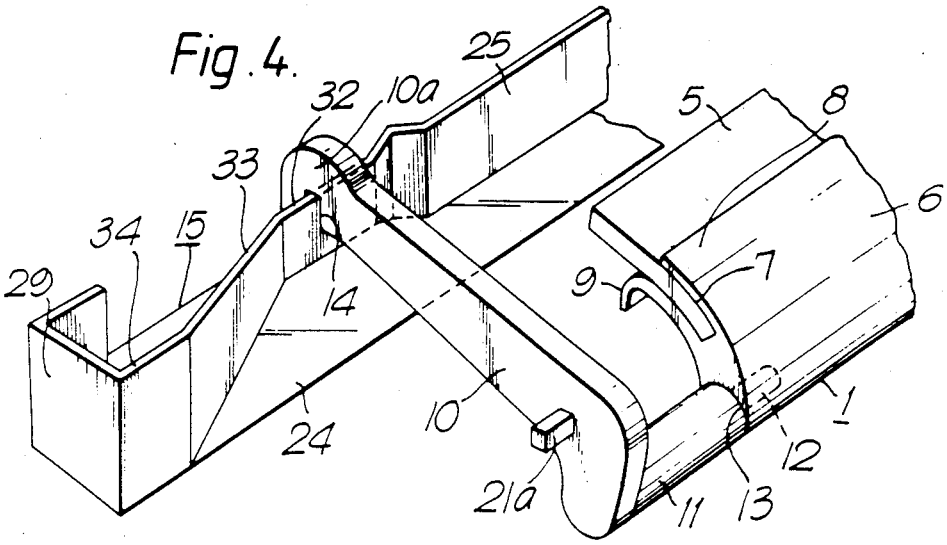

An embodiment of the invention will now be described, by way of example, with reference to the accompanying drawings in which:

FIG. 1 is a part cut-away plan view of a retractable cleaner blade apparatus in accordance with the invention, showing part of the xerographic process cassette in which it is contained, FIG. 2 is a sectional view of the apparatus in FIG. 1 with the cleaner blade in the operative, cleaning position, FIG. 3 is a sectional view of the apparatus in FIG. 2 with the cleaner blade in the retracted, sealing position, FIG. 4 is a perspective view showing a portion of the blade assembly and linear cam of the apparatus as viewed from right to left in FIG. 1, FIG. 5 is a front elevation showing the profile of the linear cam.

Referring to FIGS. 1 and 2, there is shown a portion of a xerographic cassette housing 1 containing a toner cleaner blade assembly 2 in accordance with the present invention. The xerographic cassette is suitably of the kind disclosed in our co-pending U.S. application Ser. No. 38,093, filed Apr. 14, 1987 and comprises a loosely held endless photoreceptor belt 3 supported on guide rollers 4 (only one of which is shown in FIG. 2). The cassette is intended for insertion into a xerographic copier which has an aperture to accept the cassette, within which aperture there is located a drive and location shaft for the photoreceptor which is cantilevered from the rear of the machine. As described in the aforementioned co-pending patent application this shaft may have a tapered end to aid engagement of the photoreceptor guide rollers over the shaft, and could be of the expanding mandrel type. When the cassette is inserted into the machine, the photoreceptor is located by the drive and location shaft, thus minimizing location errors between the photoreceptor and the imaging unit of the machine. Any or all of the guide rollers may be movable such as to space them further part, operable after insertion of the cassette to locate and tension the photoreceptor belt. No further details need be given about the cassette for the purposes of understanding the present invention except to note that, as well as containing the photoreceptor and cleaner blade assembly, the cassette may also contain one or more other xerographic process assemblies, such as charging, erasing, development, or transfer assemblies, as is known.

The cleaner blade assembly itself will now be described with additional reference to FIG. 4. A conventional elastomeric cleaner blade 5 made, for example, of polyurethane or the like is mounted in a blade holder 6 in such manner that the blade extends from the holder typically by about 5 to 8 mm. The holder 6 which suitably is extruded aluminum has a U-shaped slot 7 providing a tight push-fit for the blade 5. The holder 7 may be curved or angled to provide the appropriate mounting angle for the cleaner blade as discussed in more detail below. The upper side of the holder 6 is tapered at its end 8 towards the mouth of slot 7, whereas the under side of the holder 6 has a downwardly extending lip 9, the purpose of which will be described below.

The blade and holder assembly is supported between two arms 10 extending generally at right angles to the longitudinal direction of the blade 5 and holder 6. Each arm 10 has at its lower end an inwardly extending support member 11 with a narrower dimensioned extension 12 which is push-fitted into a complementary aperture at the base edge of the holder 6. At the opposite end, each of the arms 10 has a hook-like head portion **10*a* having on its underside a slot 14 for cooperating with a linear cam 15** to be described below.

The blade assembly is mounted generally above a chamber 16 for collecting waste toner. The chamber 16 is in the form of a U-shaped well or sump in the bottom of the cassette housing and contains an auger arrangement **17*a* for recirculating the toner via a further auger arrangement 17*b* extending transversely thereto back to a toner supply reservoir (not shown) from where it can be reused in the development process. Alternatively, the augers may be dispensed with altogether, in which case the chamber 16 simply acts as a storage chamber for the waste toner. As seen in FIG. 2, the side wall of the chamber 16 is lower on the left-hand side than on the right-hand side. Extending upwardly from the inside left-hand wall of the chamber is a flexible sealing strip 18, made for example from Mylar (Trade Mark) and fastened to the chamber wall. At the top of the right-hand wall of the chamfer there is provided a foam sealing block 19. The purpose of the sealing strip 18 and the sealing block 19** will be explained in more detail below.

The blade assembly is mounted in the cassette and is arranged generally above the open top of the U-shaped toner collecting chamber. A tab 21 on the outer side of each arm 10 is accommodated in respective slots 41 present within the internal wall construction of the cassette as shown schematically in FIG. 2.

The blade assembly is biased towards the photoreceptor 3 by a pair of torsion springs 20 located one at each end of the assembly, see FIG. 1, the springs bearing against posts 21 which are provided integrally with the arms 10. In the design shown in FIG. 1 the left-hand arm 10 has the spring-butting post 21 on the outside whereas the right-hand arm 10 has the post 21 on the inside. Of course, other arrangements are possible and the springs may equally be provided so that the posts 21 are both on the outside or both on the inside of the arms. As shown in FIG. 2 the spring biasing for the blade assembly may additionally (or alternatively) comprise a compression spring 40 bearing against the lower edge portion of the arm 10. Also, to assist in holding the blade assembly in place an L-shaped retaining clip 22 is slideably fixed in a channel 23 in the cassette housing. The clip 22 bears downwardly against the upper end of arm 10, allowing lateral movement of the arm 10.

Adjacent the toner collecting chamber 16 in the cassette is a channel 23 in which is slideably mounted the aforementioned linear cam 15. The three dimensional profile of the cam 15 can be seen by studying FIGS. 1, 4, and 5 in which FIG. 4 is a perspective view, and FIGS. 1 and 5 are top and side elevations respectively. The operation of the cam will be described in more detail below. The cam 15, which suitably is made of a molded plastics material, for example acetal, has a flat base 24 and an upstanding flange-like member 25 extending along the full length, generally centrally of the base. The member 25 has a similar profiled portion at each of its extremities. In the plane of the cam base 24 the profiled portion is generally S-shaped. In the plane of the member 25 the profile has a low level flat portion 32 to the left and then, moving left to right, an upwardly inclined portion 33, followed by a plateau portion 34. The arm 10 of the blade assembly is arranged so that the slot 14 therein cooperates with the upstanding flange 25, the upper end of the arm 10 thus effectively being hooked over the cam 15. The clip 22 bearing on the blade assembly acts to keep the arms 10 in intimate contact with the flange like member 25 so that they act as a pair of cam followers, the design of the cam being such that each of the arms is located at an equivalent position along the two S-shaped cam profiles. The biasing of the blade assembly 1 against the cam 15 also helps to hold the cam 15 in place vertically within the cassette.

A tension spring 26 is connected at one end to a projection 27 on the cam 15 and at the other end to a member 28 on the cassette housing 1, thus biasing the cam into the position shown in FIG. 1. This is the retracted or sealing position of the blade assembly, that is to say when the cassette is outside the xerographic machine, see also FIG. 3. In this condition the blade 5 and holder 6 are held firmly over the chamber 16 with the blade 5 butting against the foam sealing block 19 and the flexible sealing strip 18 bearing against the underside of the blade holder 6. In this manner the chamber 16 is effectively sealed by the blade assembly preventing toner from escaping when the cassette is outside the xerographic machine.

When the cassette is inserted into the xerographic machine the flat transverse end 29 of cam 15 engages a fixed actuating rod 30 projecting from the main frame of the machine. The rod enters the cassette through an aperture 31 therein. As the cassette is pushed home to its working position so the cam 15 is pushed by the rod 30 and the cam is displaced longitudinally. As the cam is displaced, the arms 10 of the blade assembly 1, acting as cam followers, are caused to move from the lowermost position of the cam profile 32 and ride up the inclined profile 33 on to the higher plateau portion 34. In this movement the arms 10 are not only shifted vertically but also longitudinally so that the whole blade assembly is raised and displaced in the direction away from the cam. When the right-hand arm 10 (see FIG. 1) has ascended the plateau portion 34 it abuts the end wall 29 of the cam 15, which acts as a stop preventing any further linear movement of the cam 15. At this point the blade assembly is in the cleaning position shown in FIG. 2 with the blade engaging the photoreceptor belt 3 below roller 4 in order to clean the residual toner therefrom. Suitably the approach angle of the blade may be arranged at a nominal 25° to the tangent at the contact point but in operation the blade will be deflected to reduce this approach angle to between 10° to 14°, for example. The loading of the blade may be chosen to be approximately 30 $gcm^{-1}$, for example.

As can be seen in FIG. 2, the depending lip 9 of the blade holder 6 bears against the flexible sealing strip 18 from the internal side of the chamber, deforming it to maximize the opening to chamber 16. At the opposite side of the chamber the sealing block 19 is arranged to ride lightly against the photoreceptor 3 thus forming a completely sealed entrance to the chamber 16 whereby all the toner scraped from the photoreceptor 3 by the blade 5 falls under gravity directly into the chamber 16 without being able to escape into other parts of the cassette which would cause contamination.

When the cassette is removed from the xerographic machine the biasing spring 26 will cause the cam to return to the position shown in FIG. 1 in which the blade assembly is moved to the chamber sealing position shown in FIG. 3 and already described above. As the blade assembly arms 10 are moved away from the photoreceptor 3 towards the cam 15 the tabs 20 on the arms 10 eventually bear against a downwardly sloping portion 35 of the slot 41 in the cassette housing. Continuing lateral movement of the cam causes the tabs 20 to follow the inclined profile of the slots 41 downwardly which assists in urging the blade assembly into a more positive sealing relationship with the flexible sealing member 18 and the sealing block 19.

As mentioned previously, it is a feature of the cassette disclosed in our co-pending U.S. application Ser. No. 38,093 that the tension in the photoreceptor belt is reduced when the cassette is outside the xerographic machine by moving one of the guide rollers. In FIG. 3 the roller 4 is thus shown displaced to the left away from the sealing block 19 so that the photoreceptor 3 is retained only loosely in readiness for the cassette to be withdrawn from the machine.

In the light of the embodiment described above it will be evident to a person skilled in the art that various modifications may be made within the scope of the present invention. For example, the projecting rod 30 from the xerographic machine may initially be retracted in order not to engage the cam until after the cassette has been fully inserted into the working position. In this case an actuating lever or other device may be provided which causes the rod to project into abutment with the cam and may also be responsible for initiating other responses within the cassette, particularly movement of the photoreceptor belt guide rollers and the consequential tensioning of the photoreceptor belt, in readiness for operation. Furthermore, although a specific form of linear cam has been described for actuating the blade assembly it will be evident that other cam designs may equally be employed, particularly for example, a rotary cam arrangement.

We claim:

1. Apparatus for separating residual toner material from the surface of a re-usable image retaining member of a reproducing machine, comprising:

blade means for chiseling removal of toner from an image retaining member arranged for movement between two positions wherein at the first position the blade means operatively engages the image retaining member to remove said residual toner material therefrom and at the second position the blade means is spaced apart from the imaging retaining member;

a generally enclosed chamber with an opening for collecting the residual toner material as it is removed by said blade means; and said second position of the blade means completely covering the opening and closing the chamber to form a sealed enclosure preventing the toner material contained therein from escaping.

2. The apparatus as defined in claim 1, further comprising spring means which bias the blade means into sealing relationship with the chamber.

3. The apparatus as defined in claim 1, wherein around the opening in the chamber there are provided sealing members arranged to abut the blade means when the blade means is in said second, sealing position.

4. A process unit adapted to be removably mounted in a main assembly of a reproducing machine, the process unit including an image retaining member loosely retained in the process unit when the process unit is removed from the main assembly and adapted to be supported in an operative position in said main assembly by an process support forming part of the main assembly, said process unit comprising:

blade means for chiseling removal of toner from an image retaining member arranged for movement between two positions, wherein at the first position the blade means operatively engages the image retaining member to remove said residual toner material therefrom and at the second position the blade means is spaced apart from the imaging retaining member;

a generally enclosed chamber with an opening for collecting the residual toner material as it is removed by said blade means; and said second position of the blade means completely covering the opening and closing the chamber to form a sealed enclosure preventing the toner material contained therein from escaping.

5. The process unit of claim 4 wherein said image retaining member is a belt photoreceptor comprising an endless flexible belt having a photosensitive surface.

6. The process unit as defined in claim 4 wherein the blade means movement is actuated by a linear cam.

7. The process unit as claimed in claim 6, wherein the linear cam is slideably mounted in a channel formed in said process unit immediately adjacent the toner collecting chamber.

8. The process unit as claimed in claim 6, wherein the linear cam is actuable by a projecting member impinging thereon upon insertion of said process unit into the main assembly.

9. The process unit as claimed in claim 6 wherein the linear cam comprises a flat base having an upstanding flange-like member providing the cam profile for pivotal and lateral movement of the blade means.

10. The process unit as claimed in claim 6 comprising spring means for biasing the cam into the position in which the blade means seals the chamber.

11. A process unit adapted to be removably mounted in a main assembly of a reproducing machine, the process unit including an image retaining member loosely retained in the process unit when the process unit is removed from the main assembly and adapted to be supported in an operative position in said main assembly by a process support forming part of the main assembly, said process unit comprising:

blade means for chiseling removal of toner from an image retaining member arranged for movement between two positions, wherein at the first position the blade means operatively engages the image retaining member to remove said residual toner material therefrom and at the second position the blade means is spaced apart from the imaging retaining member, the blade means movement actuated by a linear cam and the blade means supported at ends thereof by an arm having a hook-like portion with a slot cooperating with the linear cam as a cam follower;

a generally enclosed chamber with an opening for collecting the residual toner material as it is removed by said blade means; and said second position of the blade means covering the opening and closing the chamber to form a sealed enclosure preventing the toner material contained therein from escaping.

12. The process unit as claimed in claim 11 wherein a tab is provided on the side of each arm, which tabs are arranged to cooperate with process unit slots, the process unit slots being provided with a sloping end wall whereby as the blade means is moved to the second, sealing position, the tabs engage the sloping end wall and are moved downwardly along said end wall thereby urging the blade means into positive sealing relationship with the chamber.

13. A process unit adapted to be removably mounted in a main assembly of an imaging device, the process unit including an image retaining member loosely retained in the process unit when the process unit is removed from the main assembly and adapted to be supported in an operative position in said main assembly by a process support forming part of the main assembly, said process unit comprising:

a dual mode cleaning member operable in a first mode for chiseling removal of toner from an image retaining member for deposit into a generally enclosed residual toner collecting chamber with an opening for collecting the residual toner material as it is removed by said blade means; and said cleaning member operable in a second mode for covering the opening and closing the chamber to form a sealed enclosure preventing the toner material contained therein from escaping.

* * * * *